US005392261A

United States Patent [19]

Hsu

[11] Patent Number: 5,392,261

[45] Date of Patent: Feb. 21, 1995

[54] WATCH ASSEMBLY

[76] Inventor: Wen-Tung Hsu, No. 3, Lane 18, Syh-Wei Rd., Wuu-Guu, Taipei, Taiwan, Prov. of China

[21] Appl. No.: 186,637

[22] Filed: Jan. 26, 1994

[51] Int. Cl.[6] ..... G04B 37/00

[52] U.S. Cl. ..... 368/281

[58] Field of Search ..... 368/280, 281, 282

[56] References Cited

U.S. PATENT DOCUMENTS 1,264,650 4/1918 Horcasitas et al. ..... 368/280

2,219,277 10/1940 Kaufmann ..... 368/280

4,627,738 12/1986 Kao ..... 368/280

*Primary Examiner*—Bernard Roskoski

*Attorney, Agent, or Firm*—Jacobson, Price, Holman & Stern

[57] ABSTRACT

A watch assembly is provided which comprises a watch sub assembly and a replaceable case whereby the watch sub assembly comprising a movement, a container for the movement, a face cover and a crown, is installed into the replaceable case, having a front aperture, a rear aperture and a means to receive a crown. The diameters of the face cover and the container for the movement are equal to the diameters of the front and rear apertures respectively to enable such installation.

8 Claims, 4 Drawing Sheets

WATCH ASSEMBLY

BACKGROUND OF THE INVENTION

1. Field of the Invention

The present invention relates to a watch assembly more particularly to a wrist watch assembly having a replaceable case capable of changing the appearance of the watch in which the crown of the watch is disposed within the case=of the watch where it is not a nuisance to the wearer.

2. Description of the Prior Art

The watch assembly for a known type of wrist watch is shown in FIG. 1. In this kind of watch assembly and in the watch assembly of the present invention the body of the watch, hereinafter referred to as the watch mechanism, can be removed from its casing. This type of assembly is widely used by young people because the casing is interchangeable with other casings thereby allowing style and color changes. However the watch assembly known in the art has some drawbacks. The known watch assembly does not permit the wearer to substantially change the appearance of the watch, other than in the watch band and case. The bezel in the known assembly is not altered when the case and band are changed, therefore it is not possible to change the appearance of the front of the watch.

Another disadvantage associated with the known watch assembly is that the crown is exposed and can become a nuisance to the wearer, especially when the watch is worn on the wrist.

Another disadvantage is that in the known watch assembly the watch mechanism might easily fall out of its casing and subsequently be lost or damaged.

SUMMARY OF THE INVENTION

An object of the present invention is to provide a watch assembly which eliminates the drawbacks of the aforesaid prior art.

The present invention relates to a watch assembly in which the casing safely holds the watch and assembly in place and can be easily changed by the wearer whenever required.

The present invention also relates to a watch assembly that conceals the watch sub assembly, including the crown, within the casing of the watch, in such a way that the crown is less of a nuisance to the wearer of the watch and so that the casing then becomes an integral part of the appearance of the watch.

DETAILED DESCRIPTION OF THE PREFERRED EMBODIMENTS

Figure 1:
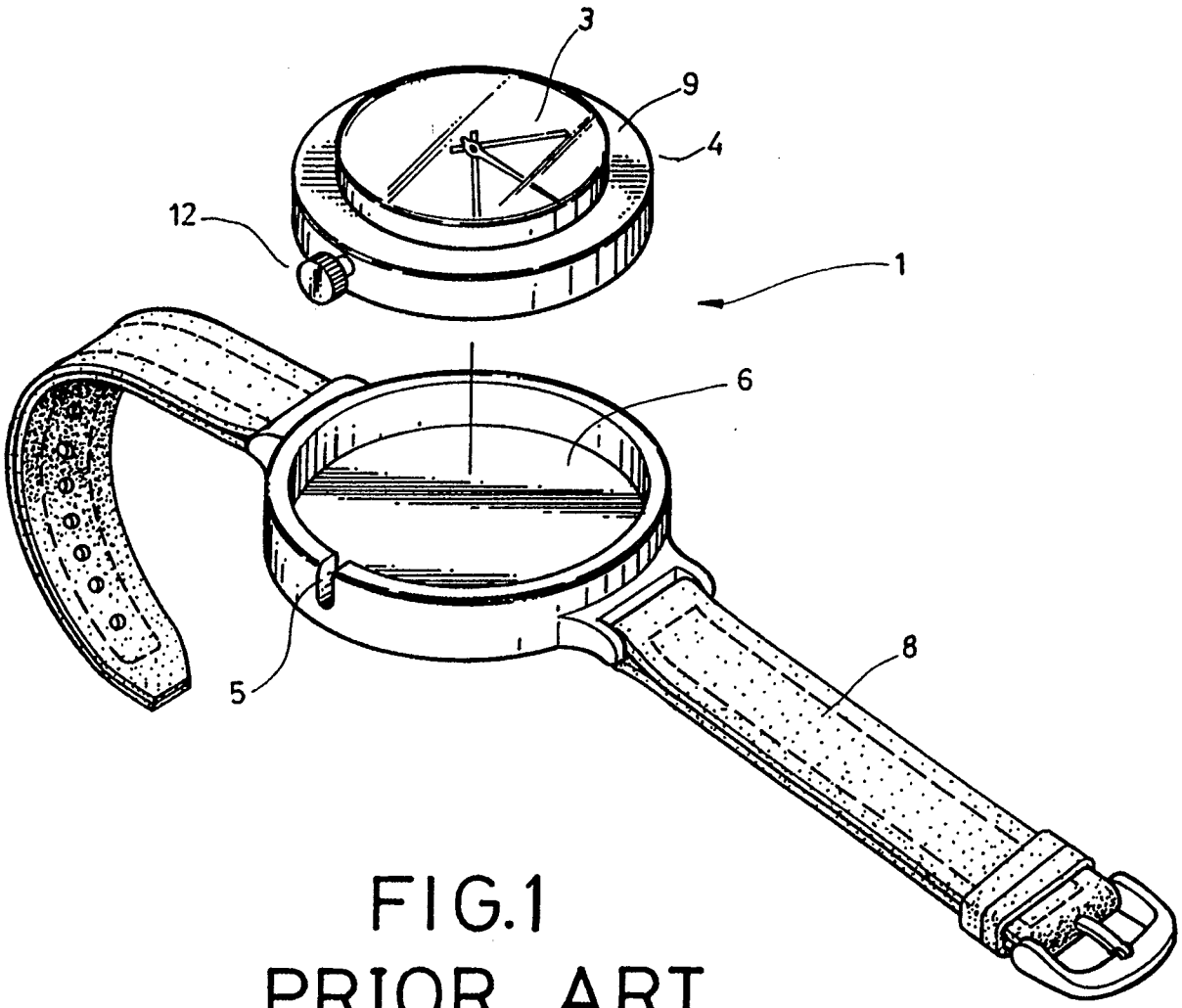
FIG.1 PRIOR ART
FIG. 1 is an exploded view of a watch assembly according to the prior art.

Referring to FIG. 1, a type of watch assembly known in the art is illustrated. In this watch assembly, like that of the present invention, a case 6 with or without a watch band 8 is replaceable. A watch sub assembly 4 of the wrist watch 1 is mounted inside the case 6. A crown 12 used to move hands 3 of the wrist watch is mounted in a slot 15 and is clearly visible. One can see how the watch assembly 4 might easily pop out of the case 6 and be lost or damaged. A bezel 9 remains unchanged and therefore the appearance of the front of the watch when the case is replaced is also unchanged.

Figures 2, 3:
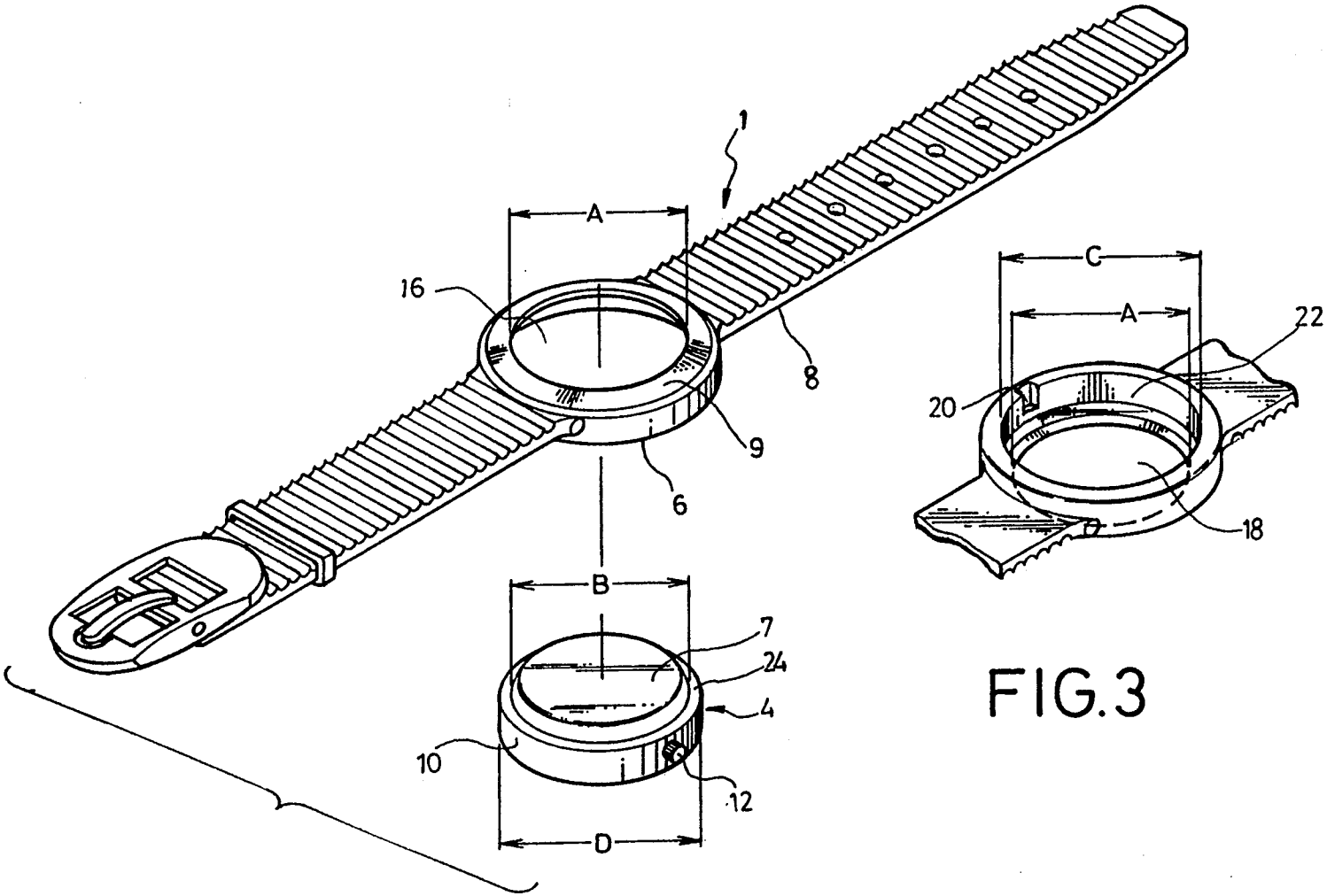
FIG. 2 is an exploded view of one embodiment of the present invention.
FIG. 3 is a rear perspective view of the watch sub assembly shown in FIG. 2.

Referring to FIGS. 2 and 3, a watch assembly according to one embodiment of the present invention wherein a wrist watch 1 comprises a watch sub assembly 4 compatible with a replaceable case 6 and a watch band 8. The watch sub assembly 4 has a face cover 7 which protects the face of the watch, a crown 12 and a container 10 which protects and contains the movement of the watch within the watch sub assembly 4.

The watch sub assembly 4 as shown in FIGS. 2 and 3 is in the shape of a cylinder, however it is possible that any shape could be used provided the case 6 is compatibly shaped so as to accommodate the watch sub assembly 4. The case 6 which is adapted to receive the watch sub assembly 4 has two apertures, a front aperture 16 and a back aperture 18. The diameter A of the front aperture 16 is approximately equal to the diameter B of the face cover 7, and through which the face of the wrist watch 1 is seen so that the wearer of the wrist watch is able to tell the time.

The diameter C of the back aperture 18 is approximately equal to the diameter D of the watch sub assembly 4. This enables the watch sub assembly 4 to be fitted with the case 6 through the back aperture 18. When the watch sub assembly 4 is assembled within the case 6, it is prevented from passing through the front aperture 16 since the diameter A of that aperture is smaller than the diameter D of the watch sub assembly 4.

A cavity 20 is provided in the peripheral wall of the back aperture 18 and is shaped to receive the crown 12. Hence, the watch sub assembly 4 is inserted through the back aperture 18 and becomes firmly assembled within the case 6. The accuracy of the diameters A, B, C and D enables the watch sub assembly 4 to be easily fitted yet safely and firmly retained.

Figure 4:
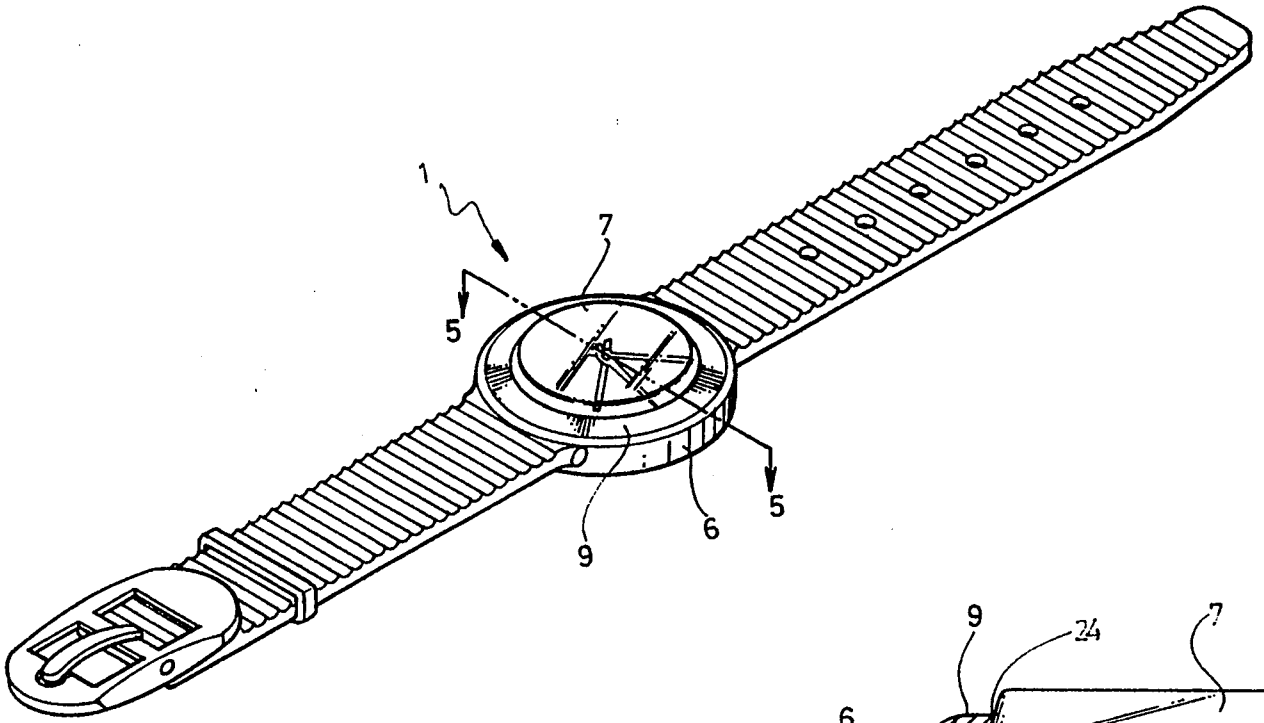
FIG. 4 is a perspective view of the watch shown in FIGS. 2 and 3 when assembled.
Figure 5:
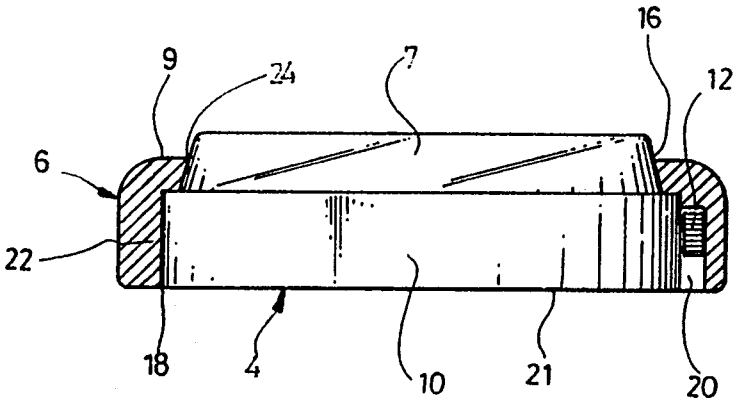
FIG. 5 is a cross sectional view taken along the line 5—5 in FIG. 4.

In FIGS. 4 and 5 the watch is seen in its assembled form. When the watch sub assembly 4 is in place within its case 6, either with or without the watch band 8, the face cover 7 is firmly positioned within the front aperture 16 of the case 6, and through which the face of the watch is visible. As more clearly shown in FIG. 5, the container 10 of the watch sub assembly 4 contacts an interior wall 22 of the case 6 and the crown 12, received in the cavity 20, is protected and obscured from sight. As shown in FIG. 4 the crown 12 is completely disposed within the case 6 and the bezel 9 remains continuous about the periphery of the face cover 7. It is then possible, by changing the case 6 of the wrist watch 1, to substantially alter the appearance of the watch since the bezel 9 is an integral part of the case 6 and can accommodate a number of different designs.

Furthermore when the crown 12 is kept within the case 6 it can not be damaged by the wearer, especially when the watch is being worn on the wrist.

When the watch is assembled and worn about the wrist, a bottom surface 21 of the container 10 closely contacts the wearer's wrist. The watch sub assembly 4 is firmly and safely held about the wearer's wrist, since the watch sub assembly 4 is not able to pass through the front aperture 16 and because a top surface 24 of the watch sub assembly 4 abuts a bottom surface of the bezel 9. The watch sub assembly 4, therefore, cannot be separated from the case 6 while being worn by the wearer.

Figure 7:
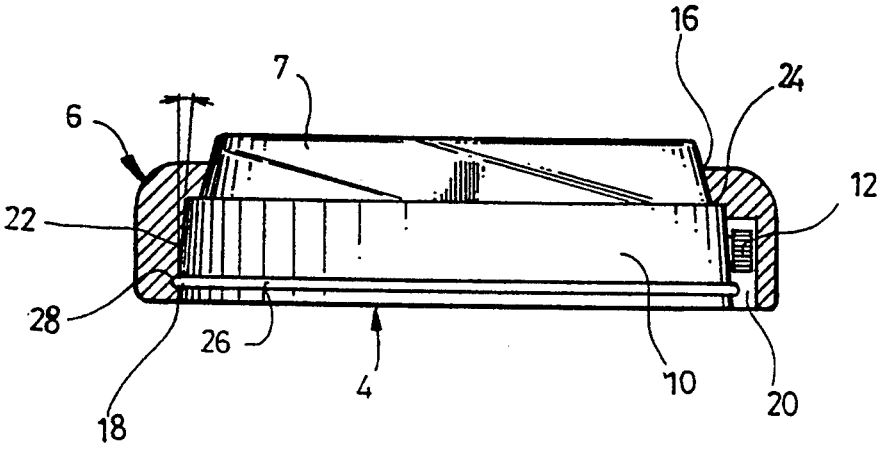
FIG. 7 is a cross sectional view of the watch assembly shown in FIG. 6.
Figure 6:
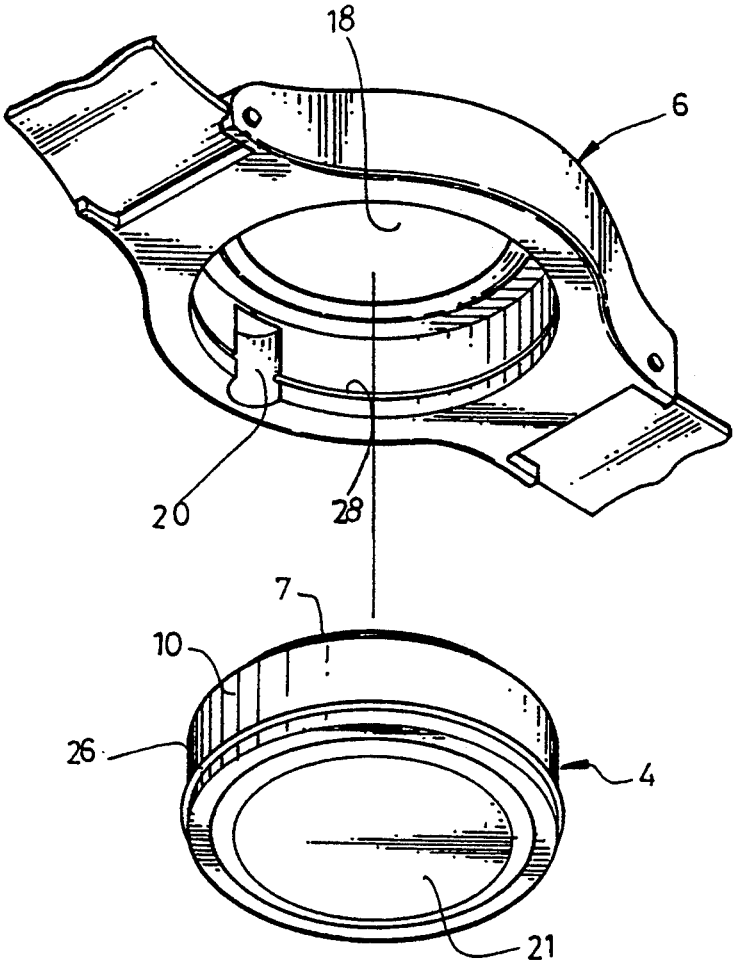
FIG. 6 is a exploded rear perspective view of a watch assembly according to a further embodiment of the present invention.

Referring to FIGS. 6 and 7, an alternative embodiment of the present invention is illustrated. In this form of the invention a watch assembly is provided whereby the diameter of the watch sub assembly 4 decreases toward the top surface 24 relative to the bottom surface 21 of the watch sub assembly 4. The shape of the watch sub assembly 4 resembles a truncated cone. The container 10 has an annular flange 26 located about its periphery. The case 6 has an annular groove 28 located at a complimentary position in the interior wall 22 of the case 6 to the annular flange 26 and accommodates the annular flange 26 when the watch is assembled. Therefore the watch sub assembly 4 is inserted into place within the case 6 through the back aperture 18 so that the annular flange 26 engages with the annular groove 28 to hold the watch sub assembly 4 securely in position.

The watch assembly of the present invention is also envisaged without the use of a wrist band so that the watch assembly 4 and case 6 can be assembled to form a different type of watch or clock.

What is claimed is:

1. A watch assembly comprising a watch sub assembly installable into a replaceable case through a rear aperture thereof, and a groove and flange arrangement to secure said watch sub assembly within said replaceable case, said watch sub assembly comprises a movement, a truncated cone shaped container for the movement, a face cover and a crown, said truncated cone shaped container having an inwardly sloping exterior wall;

said replaceable case comprises a commensurately shaped interior wall which engages with the inwardly sloping exterior wall of said watch sub assembly, a front aperture defined by a bezel, said front aperture having a diameter equal to a diameter of the face cover and a crown receiving means located in the interior wall of the replaceable case, such that when assembled, the crown is completely disposed within the replaceable case.

2. The watch assembly of claim 1 wherein the crown receiving means is a cavity.

3. The watch assembly of claim 1 wherein the groove and flange arrangement comprises an annular flange located on the inwardly sloping exterior wall of the truncated cone shaped container and an annular groove located on the interior wall of the replaceable case.

4. The watch assembly of claim 3 wherein the annular flange engages with said annular groove.

5. The watch assembly of claim 1 wherein the truncated cone shaped container of the watch sub assembly further comprises a bottom surface having a diameter equal to the diameter of the rear aperture of the replaceable case.

6. The watch assembly of claim 5 wherein the bottom surface of the truncated cone shaped container contacts a wearer's wrist when the wrist watch is being worn.

7. The watch assembly of claim 1 wherein the bezel is an integral part of the replaceable case.

8. The watch assembly of claim 1 further comprising a wrist band so that a wrist watch is formed.

* * * * *